US008577677B2

(12) United States Patent
Kim et al.

(10) Patent No.: US 8,577,677 B2
(45) Date of Patent: Nov. 5, 2013

(54) SOUND SOURCE SEPARATION METHOD AND SYSTEM USING BEAMFORMING TECHNIQUE

(75) Inventors: Hyun-Soo Kim, Yongin-si (KR); Hanseok Ko, Seoul (KR); Jounghoon Beh, Seoul (KR); Taekjin Lee, Seoul (KR)

(73) Assignees: Samsung Electronics Co., Ltd., Suwon-si (KR); Korea University Research and Business Foundation, Seoul (KR)

( * ) Notice: Subject to any disclaimer, the term of this patent is extended or adjusted under 35 U.S.C. 154(b) by 715 days.

(21) Appl. No.: 12/460,473

(22) Filed: Jul. 20, 2009

(65) Prior Publication Data

US 2010/0017206 A1 Jan. 21, 2010

(30) Foreign Application Priority Data

Jul. 21, 2008 (KR) ..... 10-2008-0070775
Jul. 22, 2008 (KR) ..... 10-2008-0071287

(51) Int. Cl.
*G10L 21/02* (2013.01)

(52) U.S. Cl.
USPC ..... 704/228

(58) Field of Classification Search
USPC ..... 704/200, 203, 205, 210, 226, 227, 225, 704/221, 228, 208, 215–218; 379/406.01
See application file for complete search history.

(56) References Cited

U.S. PATENT DOCUMENTS 6,662,155 B2 * 12/2003 Rotola-Pukkila et al. .... 704/228
7,099,822 B2 * 8/2006 Zangi ..... 704/226
7,146,003 B2 * 12/2006 Schulz et al. ..... 379/406.01

* cited by examiner

*Primary Examiner* — Huyen X. Vo

(57) ABSTRACT

A system and method for sound source separation. The system and method use a beamforming technique. The sound source separation system includes a windowing processor; a DFT transformer; a transfer function estimator; and a noise estimator. The system also includes a voice signal extractor that cancels individual voice signals, except an individual voice signal that is desired to be extracted among individual voice signals, from the integrated voice signals. The system further includes a voice signal detector that cancels a noise part provided through the noise estimator from a transfer function of an individual voice signal which is desired to be detected and extracts a noise-canceled individual voice signal. Even when two or more sound sources are simultaneously input, the sound sources can be separated from each other and separately stored and managed, or an initial sound source can be stored and managed.

20 Claims, 8 Drawing Sheets

SOUND SOURCE SEPARATION METHOD AND SYSTEM USING BEAMFORMING TECHNIQUE

CROSS-REFERENCE TO RELATED APPLICATION(S) AND CLAIM OF PRIORITY

The present application is related to and claims the benefit under 35 U.S.C. §119(a) from an application entitled "SOUND SOURCE SEPARATION METHOD AND SYSTEM USING BEAMFORMING TECHNIQUE" filed in the Korean Intellectual Property Office on Jul. 21, 2008, and Jul. 22, 2008 and assigned Serial Nos. 10-2008-0070775 and 10-2008-0071287, respectively, the entire contents of which are hereby incorporated herein by reference.

TECHNICAL FIELD OF THE INVENTION

The present invention relates to sound source separation techniques and, more particularly, to a sound source separation technique that is necessary for voice communication and recognition. Here, sound source separation refers to a technique of separating two or more sound sources which are simultaneously input to an input device (for example, a microphone array).

BACKGROUND OF THE INVENTION

A conventional noise canceling system using a microphone array includes a microphone array having at least one microphone, a short-term analyzer that is connected to each microphone, an echo canceller, an adaptive beamforming processor that cancels directional noise and turns a filter weight update on or off based on whether or not a front sound exists, a front sound detector that detects a front sound using a correlation between signals of microphones, a post-filtering unit that cancels remaining noise based on whether or not a front sound exists, and an overlap-add processor.

In the case of a beamforming technique using a microphone array, a gain of an input signal depends on an angle due to a difference between signals input to microphones. A directivity pattern also depends on an angle.

FIG. 1 illustrates a graph of a directivity pattern when a microphone array is steered at an angle of 90°.

A directivity pattern is defined as in Equation 1:

$$D(f, a_x) = \sum_{n=-\frac{N-1}{2}}^{\frac{N-1}{2}} w_n(f) e^{j2\pi a_x n d}. \quad \text{[Eqn. 1]}$$

where f denotes a frequency, N denotes the number of microphones, d denotes a distance between microphones, $w_n(f)=a_n(f)e^{j\phi_n(f)}$ denotes an amplitude weight, and $\phi_n(f)$ denotes a phase weight.

Therefore, in the beamforming technique, a directivity pattern which is generated when a microphone array is used is adjusted using $a_n(f)$ and $\phi_n(f)$, and a microphone array is steered to a direction of a desired angle.

It is possible to obtain only a signal of a desired direction through the above-described method.

Next, a Frequency Domain Blind Source Separation (FDBSS) technique is performed.

The FDBSS technique refers to a technique of separating two sound sources which are mixed with each other. The FDBSS technique is performed in a frequency domain. When the FDBSS technique is performed in a frequency domain, an algorithm becomes simplified, and a computation time is reduced.

An input signal in which two sound sources are mixed is transformed to a frequency domain signal through a Short-Time Fourier Transform (STFT). Thereafter, it is converted to signals in which sound source separation is performed through three processes of an independent component analysis (ICA).

A first process is a linear transformation.

In this process, when the number of microphones is larger than the number of sound sources, a dimension of an input signal is reduced to a dimension of a sound source through a transformation (V). Since the number of microphones is commonly larger than the number of sound sources, a dimension reduction part is included in the ICA.

In a second process, the processed signal is multiplied by a unitary matrix (B) to compute a frequency domain value of a separated signal.

In a third process, a separation matrix (V*B) obtained through the first and second processes is processed using a learning rule obtained through research.

After obtaining the separated signal through the above-described processes, localization is performed.

Due to localization, a direction from which a sound source separated by the ICA comes in is discriminated.

The next process is a permutation.

This process is performed to maintain a direction of the separated sound source "as is."

As a final process, scaling and smoothing are performed.

The scaling process is performed to adjust a magnitude of a signal in which sound source separation is performed so that a magnitude of the signal is not distorted.

To this end, a pseudo inverse of a separation matrix used for sound source separation is computed.

Thereafter, frequency responses that are sampled into L points having an interval of fs/L (fs: a sampling frequency) in the FDBSS are expressed as period signals having a period L/fs in a time domain.

This is a periodic infinite-length filter and not realistic.

For this reason, a filter in which a signal has one period in a time domain is commonly used.

However, in the case of using this filter, signal loss occurs, and separation performance deteriorates.

In order to solve the problem, a smoothing process is necessary.

In the smoothing process, a Hanning window in which both ends gradually smoothly become zero (0) is multiplied, so that a frequency response becomes smooth. As a result, signal loss is reduced, and separation performance is improved.

A technique of separating sound sources as described above is the FDBSS technique.

However, a conventional beamforming technique adjusts a directivity pattern of a microphone array to obtain a signal of a desired direction, but it has a problem in that performance deteriorates when a different sound source is present around the desired direction. That is, the conventional beamforming technique can adjust a directivity pattern to a desired direction more or less, but it is difficult to make a desired direction pointed.

The FDBSS technique has a problem in that there is a performance difference depending on a restriction condition such as the number of sound sources, reverberation, and a user position shift. Further, when the FDBSS is used for voice recognition, a missing feature compensation is necessary.

When two persons speak at the same time and voices are mixed, voice recognition performance significantly deteriorates.

In the conventional directional noise canceling system using the microphone array, a noise is estimated using a probability that a voice will be present, instead of discriminating between a voice and a non-voice, under the assumption that a noise is smaller in energy than a voice.

A noisy voice signal, which is a voice signal having a noise, is input to a microphone array 10. The noisy voice signal is transformed to a frequency-domain signal through a windowing process and the Fourier transform.

Local energy of the noisy voice signal is computed using the frequency-domain signal as in Equation 2:

$$S_f(k, l) = \sum_{i=-w}^{w} b(i)|Y(k-i, 1)|^2 \quad \text{[Eqn. 2]}$$

where $|Y(\ )|_2$ denotes a power spectrum of an input noisy voice signal, k denotes a frequency index, l denotes a frame index, and b=window function, window length=2w+1.

$$S(k,s)=\alpha_S S(k,S-1)+(1-\alpha_S)S_f(k,S),\quad 0<\alpha_S<1=\text{smoothingparameter} \quad \text{[Eqn. 3]}$$

where k denotes a frequency index, l denotes a frame index, and b=window function, window length=2w+1.

A minimum value of the local energy is computed as in Equation 4:

$$S_{min}(k,s)=\min\{S_{min}(k,S-1),S(k,S)\} \quad \text{[Eqn. 4]}$$

A ratio between the local energy of the noisy voice and the minimum value is computed as in Equation 5:

$$S_r(k,s)AS(k,s)/S_{min}(k,s) \quad \text{[Eqn. 5]}$$

Meanwhile, a threshold value δ is set. If $S_r(k,s)>\delta$, it is determined that a voice is present, and otherwise, it is determined that a voice is not present. This can be expressed as in Equation 6:

$$I(k,s)=1 \text{ if } S_r(k,S)>\delta \text{ and } I(k,S)=0 \text{ otherwise} \quad \text{[Eqn. 6]}$$

A probability value that a voice will be present is computed using a parameter for determining whether or not a voice is present as in Equation 7:

$$\hat{p}(k,s)=a_p\hat{p}(k,l-1)+(1-\alpha_p)I(k,l),\text{where } \alpha_p(0<\alpha_p<1)\text{is smoothing parameter} \quad \text{[Eqn. 7]}$$

Subsequently, noise power is estimated using the probability value that a voice will be present as in Equation 8:

$$\hat{\lambda}_d(k,l+1)=\hat{\lambda}_d(k,l)\hat{p}(k,l)+[\alpha_d\hat{\lambda}_d(k,l)+(1-\alpha_d)|Y(k,l)|^2](1-p'(k,l))=\alpha_d(k,l)\hat{\lambda}_d(k,l)+[1-\alpha_d(k,l)]Y(k,l)|^2 \quad \text{[Eqn. 8]}$$

Where $\tilde{\alpha}_d(k,l)\equiv\alpha_d+(1-\alpha_d)p'(k,l)$ and $\hat{\lambda}_d$ denotes an estimated noise.

As can be seen from Equation 8, when a voice is present, a noise value which is previously estimated is used to compute noise power, while when a voice is not present, a noise value which is previously estimated and a value of an input signal are weighted and added to compute updated noise power.

A technique of determining whether or not a voice is present in an input signal and estimating a noise in a section in which a voice is not present (i.e., a noise section) is referred to as Minima Controlled Recursive Averaging (MCRA) technique.

A second noise canceling technique is a spectral subtraction based on minimum statistic, and noise power estimation is very important in the spectral subtraction technique.

First, an input signal is frequency-transformed and then separated into a magnitude and a phase.

Of the separated values, a phase value is maintained "as is," and a magnitude value is used.

A magnitude value of a section in which only a noise is present is estimated and subtracted from a magnitude value of the input signal.

This value and the phase value are used to recover a signal, so that a noise-canceled signal is obtained.

A section in which only a noise is present is estimated using a short-time sub-band power estimation of a signal having a noise.

A short-time sub-band power estimation value computed has peaks and valleys as illustrated in FIG. 2.

Since sections having peaks are recognized as speech activity sections, noise power can be computed by estimating sections having valleys.

A technique which uses the computed noise part to cancel a noise through the spectral subtraction method is the spectral subtraction based on minimum statistic.

However, the conventional noise canceling method has a problem in that it cannot detect a change of a burst noise and so cannot appropriately reflect it in noise estimation. That is, the conventional noise canceling method has low performance for a noise which lasts a short time but has as much energy as a voice such as a footstep sound and a keyboard typing sound which are generated in an indoor environment.

Therefore, noise estimation is not accurate, and thus a noise remains. Such a remaining noise makes users uncomfortable in voice communications or causes a malfunction in a voice recognizer, thereby deteriorating performance of the voice recognizer.

That is, since a voice and a non-voice are discriminated such that a section having a value larger than an energy level or a Signal-to-Noise Ratio (SNR) is recognized as a voice section, and a section having a smaller value is recognized as a non-voice section, when an ambient noise, which has as high an energy level as a voice, is input, noise estimation and update are not performed. Therefore, the conventional noise canceling method has low performance for an ambient noise which has as high an energy level as a voice.

SUMMARY OF THE INVENTION

To address the above-discussed deficiencies of the prior art, it is a primary objective of the present invention to provide a sound source separation method and system using a beamforming technique in which two sounds which are simultaneously input are separated, whereby performance of a voice communication terminal or a voice recognizer is improved.

A first aspect of the present invention provides a sound source separation system using a beamforming technique for separating two or more different sound sources, including: a windowing processor that applies a window to an integrated voice signal input through a microphone array in which beamforming is performed; a DFT transformer that transforms the signal to which the window is applied through the windowing processor into a frequency-domain signal; a Transfer Function (TF) estimator that estimates transfer functions having feature values of two or more different individual voice signals from the signal to which the window is applied; a noise estimator that cancels noises of individual voice signals from the transfer functions having feature values of the two or more different individual voice signals which are estimated through the TF estimator; and a voice signal detector that extracts the two or more different individual voice signals from the noise-canceled voice signal.

A second aspect of the present invention provides a method of separating two or more different sound sources using a beamforming technique, including: applying a window to an integrated voice signal input through a microphone array in which beamforming is performed; DFT-transforming the signal to which the window is applied in the applying of the window into a frequency-domain signal; estimating transfer functions having feature values of two or more different individual voice signals from the signal to which the window is applied; canceling noises of individual voice signals from the transfer functions having feature values of the two or more different individual voice signals that are estimated in the estimating of the transfer functions; and extracting the two or more different individual voice signals from the noise-canceled voice signal.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION OF THE INVENTION

FIGS. 3 through 8, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged communications network.

Figure 1:
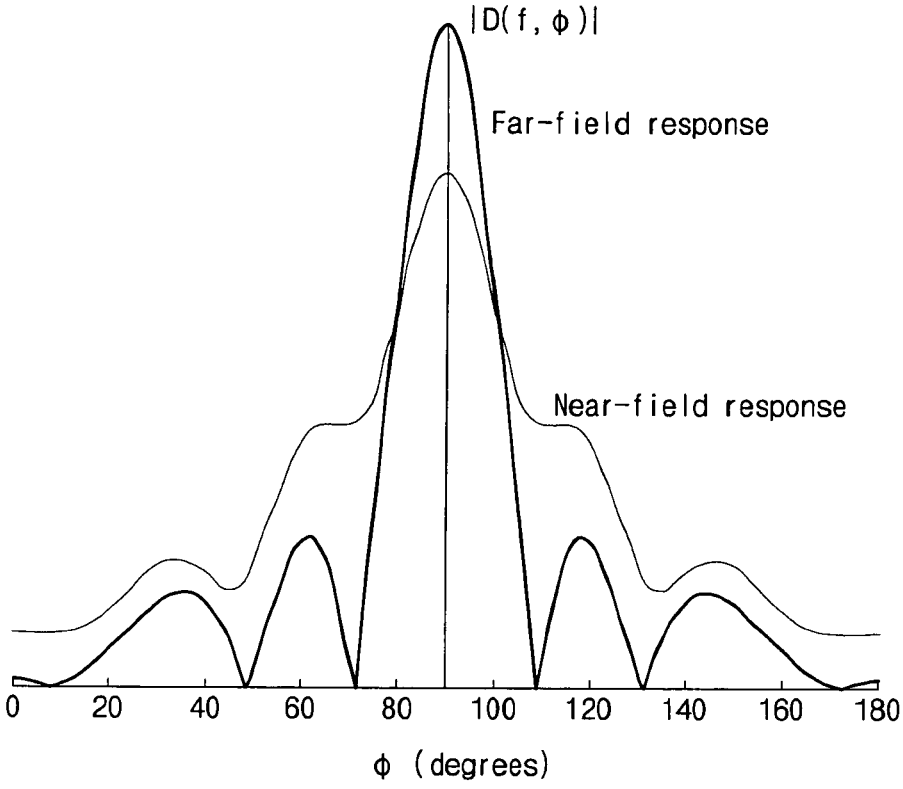
FIG. 1 illustrates a graph of a directivity pattern when a microphone array is steered at an angle of 90° in a conventional directional noise canceling system using a microphone array.
Figure 2:
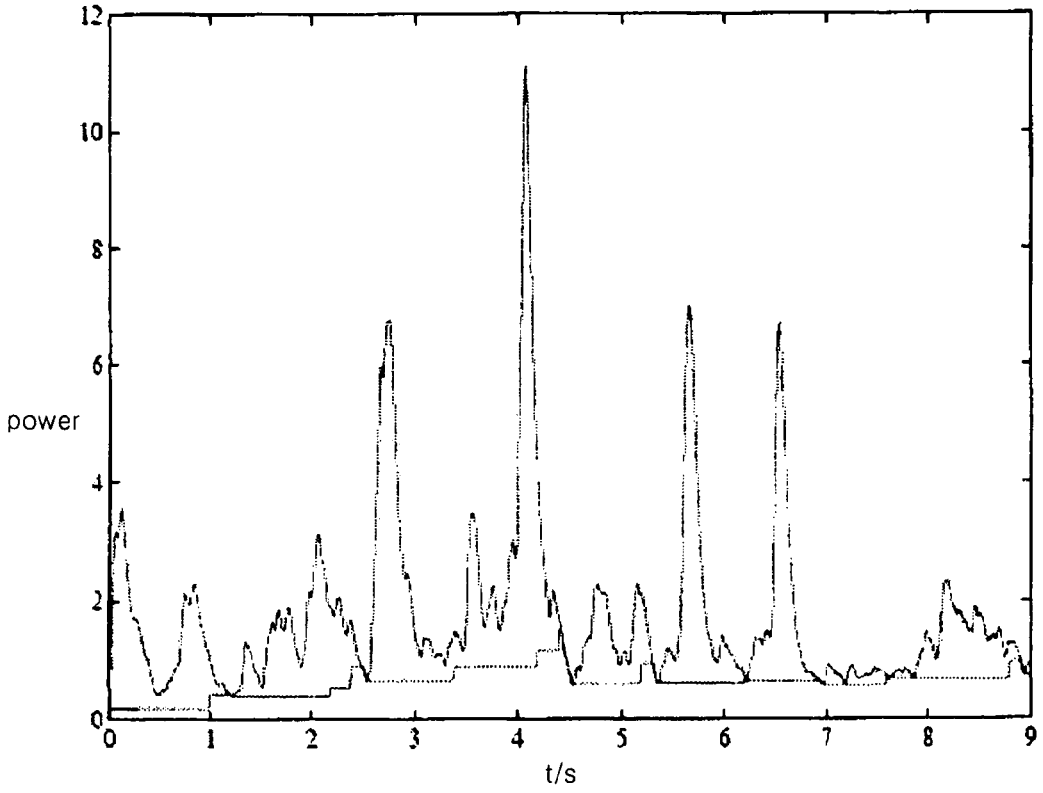
FIG. 2 illustrates a short-time sub-band power estimation value in a conventional directional noise canceling system using a microphone array.
Figure 3:
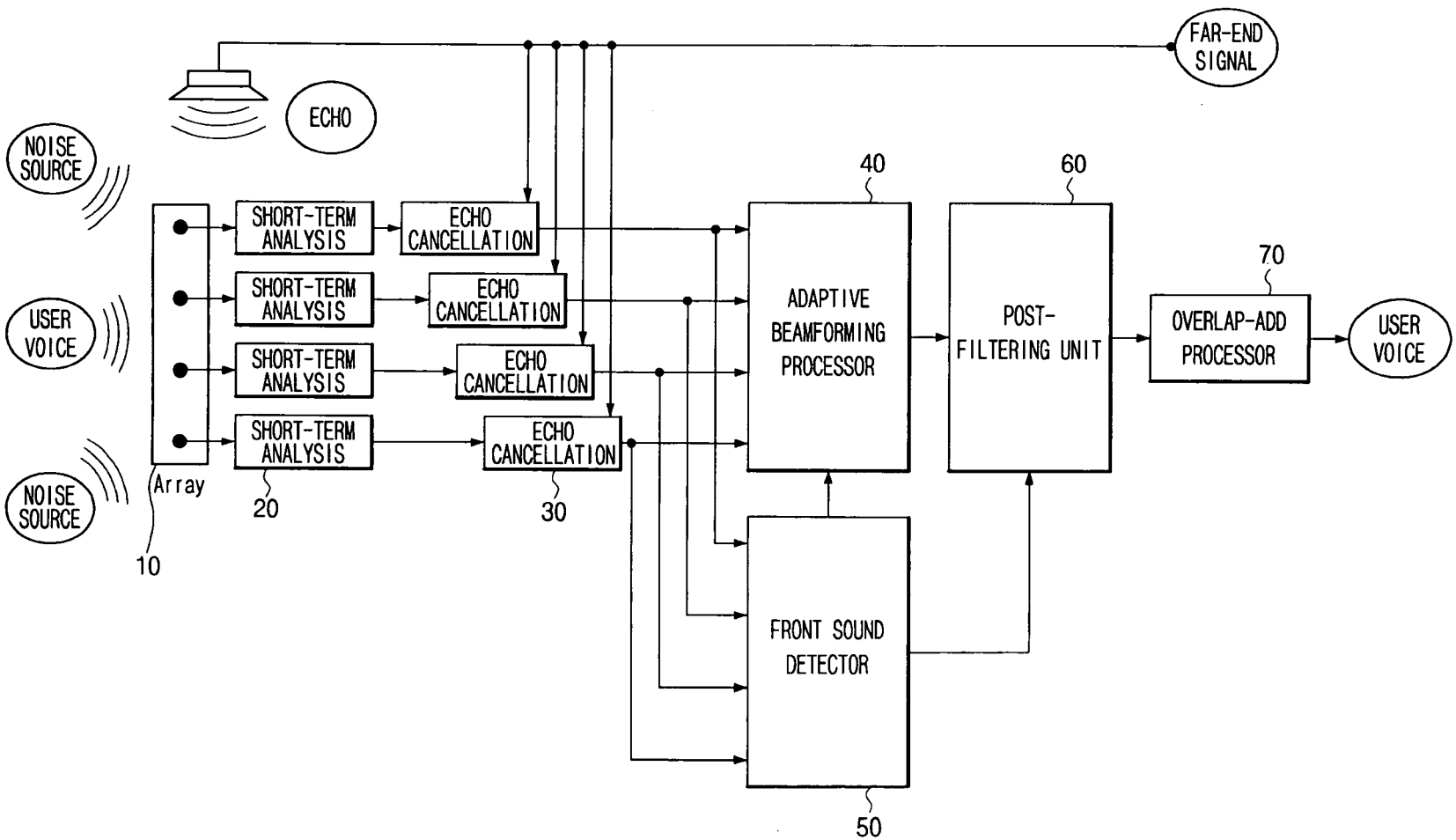
FIG. 3 illustrates a block diagram of a conventional noise canceling system using a microphone array.

FIG. 3 illustrates a block diagram of a conventional noise canceling system using a microphone array. The conventional noise canceling system of FIG. 3 includes a microphone array 10 having at least one microphone, a short-term analyzer 20 that is connected to each microphone, an echo canceller 30, an adaptive beamforming processor 40 that cancels directional noise and turns a filter weight update on or off based on whether or not a front sound exists, a front sound detector 50 that detects a front sound using a correlation between signals of microphones, a post-filtering unit 60 that cancels remaining noise based on whether or not a front sound exists, and an overlap-add processor 70.

Frequency domain analysis for voices input to the microphone array 10 is performed through the short-term analyzer 20.

One frame corresponds to 256 milliseconds (ms), and a movement section is 128 ms. Therefore, 256 ms is sampled into 4,096 at 16 Kilohertz (Khz), and a Hanning window is applied.

Thereafter, a DFT is performed using a real Fast Fourier Transform (FFT), and an ETSI standard feature extraction program is used as a source code.

Directional noise is canceled through the adaptive beamforming processor 40.

The adaptive beamforming processor 40 uses a generalized sidelobe canceller (GSC).

This is similar to a method of estimating a path in which a far-end signal arrives at an array from a speaker to cancel an echo.

Figure 4:
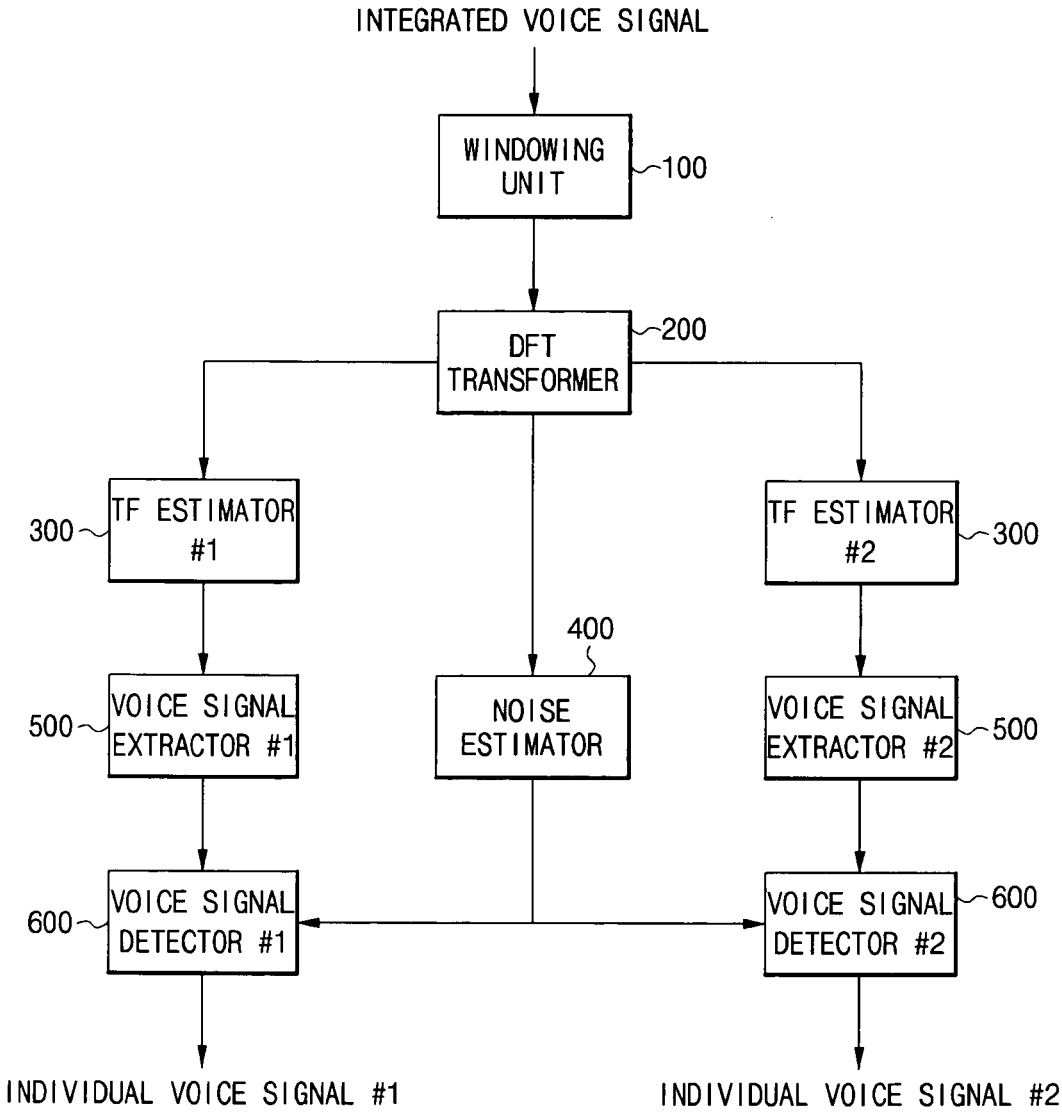
FIG. 4 illustrates a block diagram of a sound source separation system using a beamforming technique according to an exemplary embodiment of the present invention.

FIG. 4 illustrates a block diagram of a sound source separation system using a beamforming technique according to an exemplary embodiment of the present invention. The sound source separation system of FIG. 4 includes a windowing unit 100, a DFT transformer 200, at least one transfer function (TF) estimator 300, a noise estimator 400, at least one voice signal extractor 500, and at least one voice signal detector 600. The voice signal detector 600 may include an inverse discrete Fourier transform (IDFT) transformer 610.

The windowing unit 100 applies a Hanning window to an integrated voice signal having at least one voice which is input through the microphone array to be divided into frames. The windowing unit 100 may be provided with an integrated voice signal, which is input through the microphone array 10, through the short-term analyzer 20 and the echo canceller 30.

A length of a Hanning widow applied through the windowing unit 100 is 32 ms, and a movement section is 16 ms.

The DFT transformer 200 transforms individual voice signals, which are respectively divided into frames through the windowing unit 100, into frequency-domain signals.

The TF estimator 300 obtains impulse responses for frames, which are transformed into a frequency-domain signal through the DFT transformer 200, to estimate transfer functions of individual voice signals. The TF estimator 300 obtains impulse responses between microphones during an arbitrary time to estimate transfer functions, with respect to a voice signal of a previously set direction.

Figure 5:
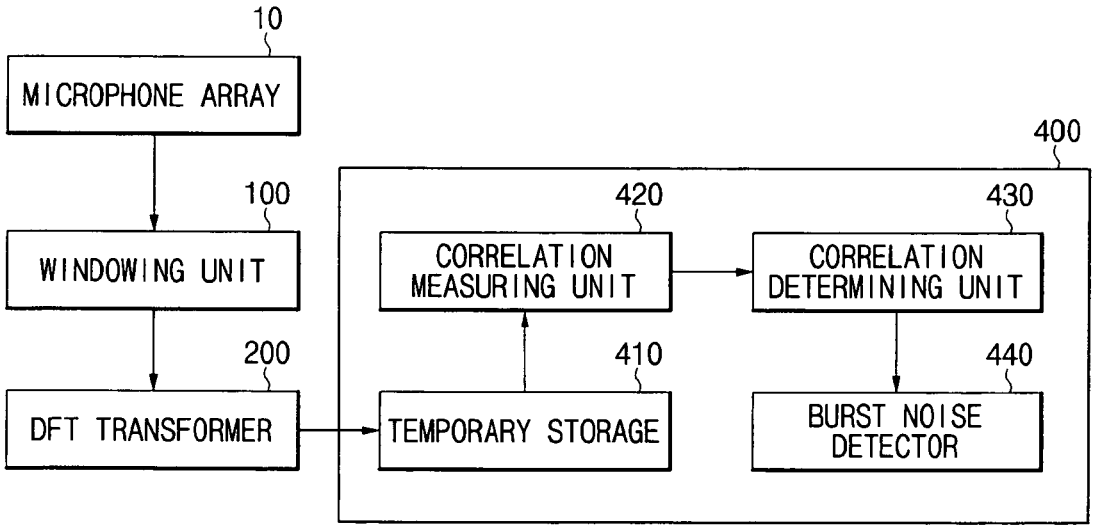
FIG. 5 illustrates a block diagram of a noise estimator of the sound source separation system of FIG. 4.
Figure 6:
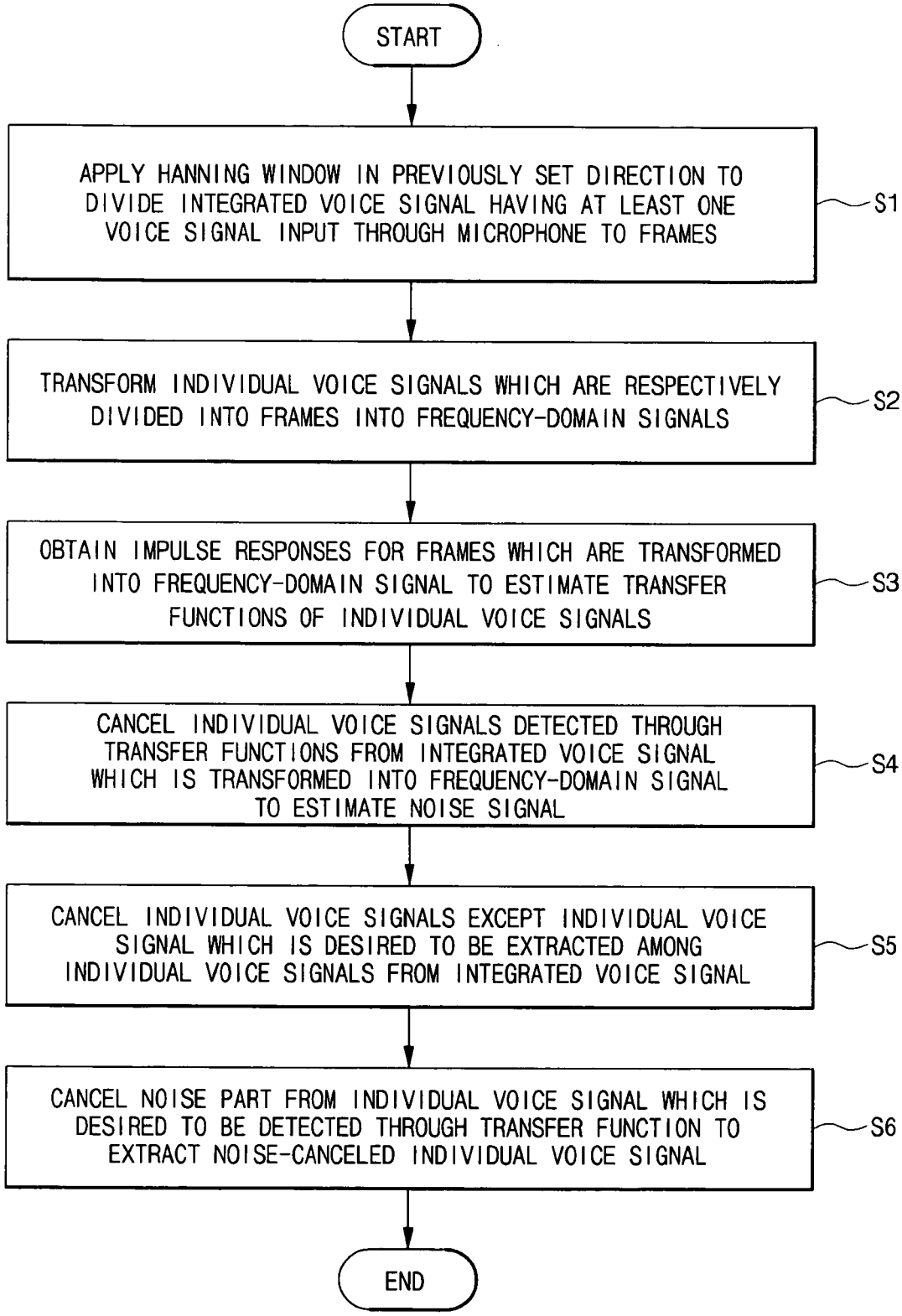
FIG. 6 illustrates a flowchart for a sound source separation method using a beamforming technique according to an exemplary embodiment.
Figure 7:
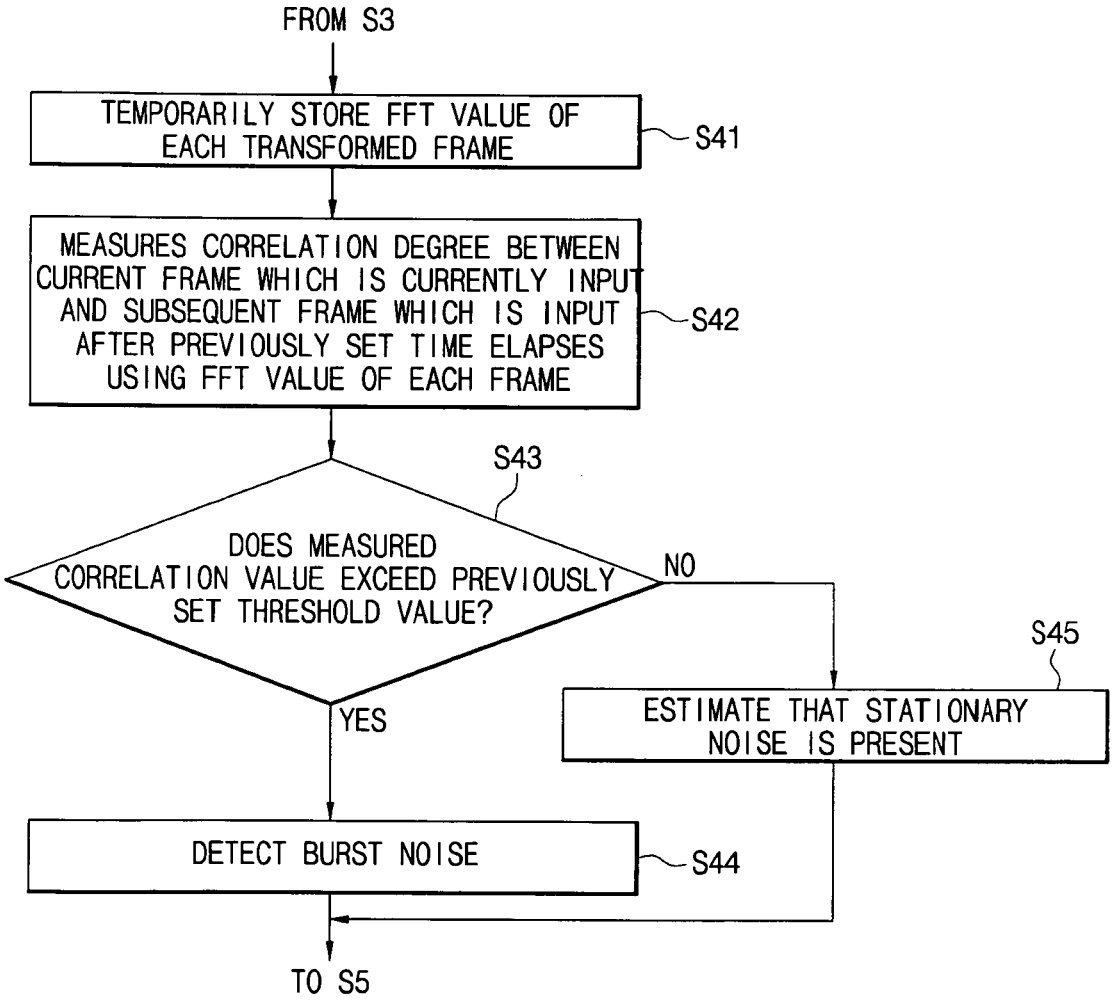
FIG. 7 illustrates a flowchart for a noise estimation process S4 according to an exemplary embodiment.

The noise estimator 400 estimates a noise signal by canceling individual voice signals, which are detected through transfer functions estimated through the TF estimator 300, from the integrated voice signal that is transformed into the frequency-domain signal through the DFT transformer 200. The noise estimator 400 includes a temporary storage 410, a correlation measuring unit 420, a correlation determining unit 430, and a burst noise detector 440 as illustrated in FIG. 5.

The temporary storage 410 of the noise estimator 400 temporarily stores a FFT value for each frame, which is transformed through the DFT transformer 200.

The correlation measuring unit 420 of the noise estimator 400 measures a correlation degree between a current frame that is currently input and a subsequent frame that is input after a previously set time elapses.

The correlation determining unit 430 of the noise estimator 400 determines whether or not a correlation value measured through the correlation measuring unit 420 exceeds a previously set threshold value. Here, a spectrum magnitude value of a frame that is currently input and a spectrum magnitude value of a subsequent frame that is input after a previously set time elapses are squared using a cross-power spectrum and summed in an overall frequency domain, and the resultant is defined as energy of a corresponding frame, and a ratio between a frame in which energy is detected through a cross-power spectrum and a noise that is estimated based on local energy at an arbitrary frequency and a minimum statistic value is defined.

Threshold values are given to the energy $\gamma$ (s) of a corresponding frame and the ratio $S_r(s,k)$. The correlation determining unit 430 determines that a burst noise is present when $\gamma(s)$ is smaller than the corresponding threshold value and $S_r(s,k)$ is larger than the corresponding threshold value.

The burst noise detector 440 of the noise estimator 400 detects a burst noise when the correlation determining unit 430 determines that the correlation value exceeds the previously set threshold value. At this time, the burst noise detector 440 applies a parameter for obtaining a burst noise to an existing MCRA noise estimation technique and obtains and cancels a burst noise as in Equations 9 to 11.

$$\hat{\lambda}(k,l+1)=\alpha(k,l)\hat{\lambda}(k,l+1)+(1-\alpha(k,l))|Y(k,l)|^2 \quad \text{[Eqn. 9]}$$

where $\hat{\lambda}(k,l+1)$ denotes an estimated noise, k denotes a frequency index, and l denotes a frame index.

$$\alpha(k,l)=\tilde{\alpha}(k,l)+(1-\tilde{\alpha}(k,l))p(k,l)(1-I_1(k,l))$$

$$\alpha(k,l)=\tilde{\alpha}(k,l)+(1-\tilde{\alpha}(k,l))p(k,l)(1-I_1(k,l)) \quad \text{[Eqn. 10]}$$

where p(k,l) denotes a probability that a voice will be present, k denotes a frequency index, and l denotes a frame index.

$$\tilde{\alpha}(k,l)=\alpha_{ds}+(\alpha_{dt}-\alpha_{ds})I_1(k,l) \quad \text{[Eqn. 11]}$$

where $\alpha_{ds}=0.95$, and $\alpha_{dt}=0.05$, and $\alpha_{ds}$ and $\alpha_{dt}$ denote update coefficients of a stationary noise section and a burst noise section, respectively.

When a burst noise is not detected, the burst noise detector 440 estimates that a stationary noise is present.

The voice signal extractor 500 cancels individual voice signals except an individual voice signal that is desired to be extracted among individual voice signals provided through the TF estimator 300 from the integrated voice signal provided through the DFT transformer 200.

The voice signal detector 600 cancels a noise part provided through the noise estimator 400 from an individual voice signal that is desired to be detected through the transfer function and extracts a noise-canceled individual voice signal. The voice signal detector 600 transforms a frequency-domain individual voice signal to a time-domain individual voice signal through the IDFT transformer 610.

Functions and operations of the components described above will be described below focusing on sound source separation according to an exemplary embodiment of the present invention.

The microphone array 10 receives an integrated voice signal in which two voice signals are mixed and provides the windowing unit 100 with the integrated voice signal. Here, signals input through microphones of the microphone array 10 are slightly different from each other due to a distance between microphones.

The windowing unit 100 applies a Hanning window to the integrated voice signal in a previously set direction to be divided into frames having a 32 ms section. The frame that is divided in this process is divided while moving by a 16 ms section.

A direction in which the windowing unit 100 applies a Hanning window is previously set, and the number of Hanning windows depends on the number of people and is not limited.

The DFT transformer 200 transforms each individual voice signal, which is divided into frames through the windowing unit 100, into frequency-domain signals.

The TF estimator 300 obtains an impulse response of a frame that is transformed into a frequency-domain signal through the DFT transformer 200 and estimates a transfer function of the individual voice signal. The TF estimator 300 may estimate transfer functions of two individual voice signals, or the two TF estimators 300 may be used to estimate transfer functions of two individual voice signals, respectively. The TF estimator 300 obtains an impulse response between microphones during an arbitrary time to estimate a transfer function, with respect to a voice signal of a previously set direction.

When the transfer functions of the individual voice signals are estimated by the TF estimator 300 or the two TF estimators 300, the noise estimator 400 estimates a noise signal by canceling the individual voice signals detected through the transfer functions estimated through the TF estimator 300 from the integrated voice signal that is transformed into the frequency-domain signal through the DFT transformer 200.

A FFT value of each frame transformed through the DFT transformer 200 is temporarily stored in the temporary storage 410.

The correlation measuring unit 420 measures a correlation degree between a current frame 1 that is currently input and a subsequent frame (1+N) that is input after a previously set time N elapses. N denotes the number of frames corresponding to a section equal to or more than a minimum of 100 ms.

The correlation determining unit 430 determines whether or not a correlation value measured through the correlation measuring unit 420 exceeds a previously set threshold value.

Here, a spectrum magnitude value of a frame that is currently input and a spectrum magnitude value of a subsequent frame that is input after a previously set time elapses are squared using a cross-power spectrum and summed in an overall frequency domain, and the resultant is defined as energy $\gamma(s)$ of a corresponding frame, and a ratio $S_r(s,k)$ between a frame in which energy is detected through a cross-power spectrum and a noise that is estimated based on local energy at an arbitrary frequency and a minimum statistic value is defined. Threshold values are given to the energy γ(S) of a corresponding frame and the ratio $S_r(s,k)$. The correlation determining unit 430 determines that a burst noise is present when γ(s) is smaller than the corresponding threshold value and $S_r(s,k)$ is larger than the corresponding threshold value.

The burst noise detector 440 detects a burst noise when the correlation determining unit 430 determines that the correlation value exceeds the previously set threshold value.

The burst noise detector 440 applies a parameter for obtaining a burst noise to the existing MCRA noise estimation technique and obtains and cancels a burst noise as in Equations 9 to 11:

$$\hat{\lambda}(k,l+1)=\alpha(k,l)\hat{\lambda}(k,l+1)+(1-\alpha(k,l))|Y(k,l)|^2 \quad \text{[Eqn. 9]}$$

where $\hat{\lambda}(k,l+1)$ denotes an estimated noise, k denotes a frequency index, and l denotes a frame index.

$$\alpha(k,l)=\tilde{\alpha}(k,l)+(1-\tilde{\alpha}(k,l))p(k,l)(1-I_1(k,l)) \quad \text{[Eqn. 10]}$$

where p(k,l) denotes a probability that a voice will be present, k denotes a frequency index, and l denotes a frame index.

$$\tilde{\alpha}(k,l)=\alpha_{ds}+(\alpha_{dt}-\alpha_{ds})I_1(k,l) \quad \text{[Eqn. 11]}$$

where $\alpha_{ds}=0.95$, and $\alpha_{dt}=0.05$, and $\alpha_{ds}$ and $\alpha_{dt}$ denote update coefficients of a stationary noise section and a burst noise section, respectively.

When a burst noise is not detected, the burst noise detector 440 estimates that a stationary noise is present.

The voice signal extractor 500 cancels transfer functions of individual voice signals except a transfer function of an individual voice signal that is desired to be extracted among transfer functions of individual voice signals provided through the TF estimator 300 from the integrated voice signal provided through the DFT transformer 200. As a result, an individual voice signal that is desired to be extracted may be extracted.

The voice signal detector 600 cancels a noise part provided through the noise estimator 400 from an individual voice signal that is desired to be detected through the transfer function and extracts a noise-canceled individual voice signal. The voice signal detector 600 transforms a frequency-domain individual voice signal to a time-domain individual voice signal through the IDFT transformer 610.

Next, a sound source separation method using a beamforming technique according to an exemplary embodiment of the present invention will be described.

When an integrated voice signal having at least one voice signal is input through the microphone array 10, a Hanning window is applied in a previously set direction to divide the integrated voice signal into frames (S1). In the windowing process S1, a length of a Hanning window is 32 ms, and a movement section is 16 ms.

Thereafter, individual voice signals, which are respectively divided into frames, are transformed into frequency-domain signals (S2).

Impulse responses for frames, which are transformed into a frequency-domain signal, are obtained to estimate transfer functions of individual voice signals (S3). In the transfer function estimation process S3, with respect to a voice signal of a previously set direction, impulse responses between microphones are obtained during an arbitrary time (5 seconds) to estimate transfer functions.

Individual voice signals detected through the transfer functions are canceled from the integrated voice signal that is transformed into the frequency-domain signal to estimate a noise signal (S4). The noise signal estimation process S4 will be described below in further detail with reference to FIG. 7.

A FFT value of each transformed frame is temporarily stored (S41).

A correlation degree between a current frame that is currently input and a subsequent frame that is input after a previously set time elapses is measured using the FFT value of each frame (S42).

It is determined whether or not the measured correlation value exceeds a previously set threshold value (S43).

Figure 8:
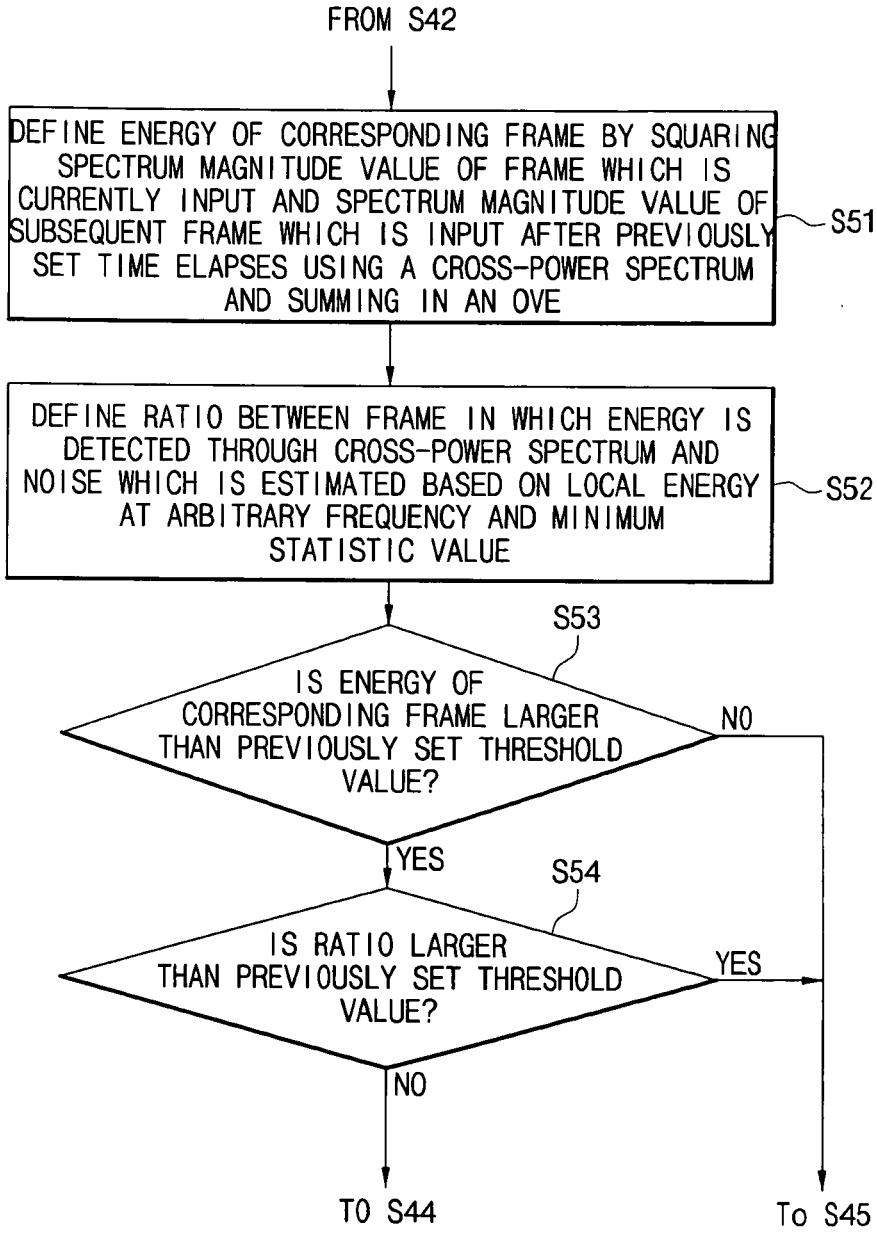
FIG. 8 illustrates a flowchart for a correlation determining process S43 according to an exemplary embodiment.

The correlation determining process S43 will be described in further detail with reference to FIG. 8.

A spectrum magnitude value of a frame that is currently input and a spectrum magnitude value of a subsequent frame that is input after a previously set time elapses are squared using a cross-power spectrum and summed in an overall frequency domain, and the resultant is defined as energy γ(s) of a corresponding frame (S51).

A ratio $S_r(s,k)$ between a frame in which energy is detected through a cross-power spectrum and a noise which is estimated based on local energy at an arbitrary frequency and a minimum statistic value is defined.

It is determined whether or not the energy γ(s) of a corresponding frame is larger than a previously set threshold value (S53).

When the energy γ(s) of the corresponding frame is smaller than the previously set threshold value, it is determined whether the ratio $S_r(s,k)$ is larger than a previously set threshold value (S54).

A burst noise is detected and canceled when it is determined in the correlation determining process S43 that the correlation value exceeds the previously set threshold value (S44).

In the burst noise detecting process S44, a parameter for obtaining a burst noise is applied to an existing MCRA noise estimation technique to obtain and cancel a burst noise as in Equations 9 to 11:

$$\hat{\lambda}(k,l+1)=\alpha(k,l)\hat{\lambda}(k,l+1)+(1-\alpha(k,l))|Y(k,l)|^2 \quad \text{[Eqn. 9]}$$

where $\hat{\lambda}(k,l+1)$ denotes an estimated noise, k denotes a frequency index, and l denotes a frame index.

$$\alpha(k,l)=\tilde{\alpha}(k,l)+(1-\tilde{\alpha}(k,l))p(k,l)(1-I_1(k,l)) \quad \text{[Eqn. 10]}$$

where p(k,l) denotes a probability that a voice will be present, k denotes a frequency index, and l denotes a frame index.

$$\tilde{\alpha}(k,l)=\alpha_{ds}+(\alpha_{dt}-\alpha_{ds})I_1(k,l) \quad \text{[Eqn. 11]}$$

where $\alpha_{ds}=0.95$, and $\alpha_{dt}=0.05$, and $\alpha_{ds}$ and $\alpha_{dt}$ denote update coefficients of a stationary noise section and a burst noise section, respectively.

When the energy γ(s) of the corresponding frame is larger than the previously set threshold value or when the ratio $S_r(s,k)$ is smaller than the previously set threshold value, it is determined that a burst noise is not present, and thus it is estimated that a stationary noise is present (S45).

Thereafter, individual voice signals except an individual voice signal which is desired to be extracted among the individual voice signals are canceled from the integrated voice signal (S5).

A noise part is canceled from an individual voice signal that is desired to be detected through the transfer function to extract a noise-canceled individual voice signal (S6). In the voice signal detecting process S6, a frequency-domain individual voice signal is transformed to a time-domain individual voice signal.

As described above, the sound source separation method and system using the beam forming technique according to an exemplary embodiment of the present invention has an advantage of being capable of separating two or more sound sources which are simultaneously input and separately storing the separated sound sources or storing an initial sound source.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A sound source separation system using a beamforming technique configured to separate two or more different sound sources, the system comprising:

a windowing processor configured to apply a plurality of windows to an integrated voice signal input through a microphone array in which beamforming is performed;

a DFT transformer configured to transform the integrated voice signal to which the windows are applied through the windowing processor into a plurality of frequency-domain signals;

a transfer function (TF) estimator configured to estimate transfer functions having feature values of two or more different individual voice signals from the integrated voice signal to which the windows are applied;

a noise estimator configured to:

determine whether stationary noise or burst noise is detected in the integrated voice signal by comparing a measured energy in one window with a measured energy in a previous window; and cancel the stationary noise or the burst noise from the one window of the integrated voice signal; and a voice signal detector configured to extract the two or more different individual voice signals from the noise-canceled integrated voice signal, wherein the noise estimator comprises:

a temporary storage unit configured to temporarily store an FFT value of each window transformed through the DFT transformer;

a correlation measuring unit configured to measure a correlation value between the one window with the previous window and compute the energy of the one window and the previous window;

a correlation determining unit configured to determine whether the correlation value measured by the correlation measuring unit exceeds a previously set threshold value; and a burst noise detector configured to detect the stationary noise or the burst noise using the correlation value and the energy.

2. The sound source separation system of claim 1, wherein the TF estimator is configured to estimate the transfer functions using impulse responses obtained through values transformed by the DFT transformer.

3. The sound source separation system of claim 1, wherein the number of the TF estimators is identical to the number of different sound sources.

4. The sound source separation system of claim 1, further comprising, at least one voice signal extractor configured to cancel individual voice signals except an individual voice signal that is desired to be extracted among individual voice signals provided through the TF estimator from the integrated voice signals provided through the DFT transformer.

5. The sound source separation system of claim 1, wherein the windowing processor is configured to apply a Hanning window, wherein a length of the Hanning window is 32 milliseconds (ms), and a movement section is 16 ms.

6. The sound source separation system of claim 5, wherein the TF estimator is configured to obtain impulse responses between microphones during an arbitrary time to estimate transfer functions, with respect to a voice signal of a previously set direction.

7. The sound source separation system of claim 1, wherein the noise detector is configured to determine that a burst noise is present when it is determined by the correlation determining unit that the correlation value exceeds the previously set threshold value.

8. The sound source separation system of claim 7, wherein the correlation determining unit is configured to:

define energy $\gamma(s)$ by squaring a spectrum magnitude value of the previous window that is currently input and a previous spectrum magnitude value of the one window that is input after a previously set time elapses using a cross-power spectrum and summing in an overall frequency domain;

define a ratio $S_r(s,k)$ between a window in which energy is detected through a cross-power spectrum and a noise that is estimated based on local energy at an arbitrary frequency and a minimum statistic value; and determine that the burst noise is present when $\gamma(s)$ is smaller than the predetermined threshold value and $S_r(s,k)$ is larger than the predetermined threshold value.

9. The sound source separation system of claim 8, wherein the noise detector is configured to apply a parameter for obtaining the burst noise to an existing MCRA noise estimation technique to obtain a burst noise as in a first, second and third equation:

the first equation defined as $\hat{\lambda}(k,l+1)=\alpha(k,l)\hat{\lambda}(k,l+1)+(1-\alpha(k,l))|Y(k,l)|^2$, where $\hat{\lambda}(k,l+1)$ denotes an estimated noise, k denotes a frequency index, and l denotes a frame index;

the second equation is defined as $\alpha(k,l)=\tilde{\alpha}(k,l)+(1-\tilde{\alpha}(k,l))p(k,l)(1-I_1(k,l))$, where $p(k,l)$ denotes a probability that a voice will be present, k denotes a frequency index, and l denotes a frame index; and wherein the third equation is defined as $$\tilde{\alpha}(k,l)=\alpha_{ds}+(\alpha_{dt}-\alpha_{ds})I_1(k,l),$$

where $\alpha_{ds}=0.95$, and $\alpha_{dt}=0.05$, and $\alpha_{ds}$ and $\alpha_{dt}$ denote update coefficients of a stationary noise section and a burst noise section, respectively.

10. The sound source separation system of claim 1, wherein the noise estimator is configured to, when a burst noise is not detected, estimate that a stationary noise is present.

11. A method of separating two or more different sound sources using a beamforming technique, the method comprising:

applying a plurality of windows to an integrated voice signal input through a microphone array in which beamforming is performed;

DFT-transforming the integrated voice signal to which the windows are applied in the applying of the window into a plurality of frequency-domain signals;

estimating transfer functions (TFs) having feature values of two or more different individual voice signals from the integrated voice signal to which the windows are applied;

determining whether stationary noise or burst noise is detected in the integrated voice signal by comparing a measured energy in one window with a measured energy in a previous window;

canceling the stationary noise or the burst noise from the one window of the integrated voice signal; and extracting the two or more different individual voice signals from the noise-canceled integrated voice signal, wherein canceling the stationary noise or the burst noise from the one window of the integrated voice signal comprises:

temporarily storing an FFT value of each transformed window;

computing energy of the previous window and the one window and measuring a correlation value between the previous window that is currently input and the one window that is input after a previously set time elapses using the FFT value of each frame stored;

determining whether the measured correlation value exceeds a previously set threshold value; and when it is determined that the correlation value exceeds a previously set threshold value, detecting and canceling the stationary noise or the burst noise.

12. The method of claim 11, wherein estimating the transfer functions further comprises estimating the transfer functions using impulse responses obtained through values that are DFT-transformed.

13. The method of claim 11, wherein the estimating of the transfer functions is performed a number of times equal to the number of different sound sources.

14. The method of claim 11, further comprising canceling individual voice signals except an individual voice signal that is desired to be extracted among individual voice signals provided in the estimating of the transfer functions from the integrated voice signals provided through the DFT-transforming of the voice integrated signal.

15. The method of claim 11, wherein applying the window further comprises applying a Hanning window, wherein a length of the Hanning window is 32 milliseconds (ms), and a movement section is 16 ms.

16. The method of claim 15, wherein estimating the transfer functions, further comprises obtaining impulse responses between microphones during an arbitrary time to estimate transfer functions with respect to a voice signal of a previously set direction.

17. The method of claim 11, further comprising, after determining whether or not the measured correlation value exceeds a previously set threshold value, determining that a burst noise is present when the correlation value exceeds the previously set threshold value.

18. The method of claim 17, wherein the determining of whether or not the measured correlation value exceeds the previously set threshold value comprises:

defining energy $\gamma(s)$ by squaring a spectrum magnitude value of the previous window that is currently input and a previous spectrum magnitude value of the one window that is input after a previously set time elapses using a cross-power spectrum and summing in an overall frequency domain;

defining a ratio $S_r(s,k)$ between a window in which energy is detected through a cross-power spectrum and a noise that is estimated based on local energy at an arbitrary frequency and a minimum statistic value;

determining whether or not the energy $\gamma(s)$ of the corresponding frame is larger than a previously set threshold value; and when the energy $\gamma(s)$ of the corresponding frame is smaller than a previously set threshold value, determining whether or not the ratio $S_r(s,k)$ is larger than a previously set threshold value.

19. The method of claim 18, wherein detecting and canceling the burst noise further comprises applying a parameter for obtaining the burst noise to an existing MCRA noise estimation technique to obtain a burst noise as in a first, second and third equation:

the first equation defined as $$\hat{\lambda}(k,l+1)=\alpha(k,l)\hat{\lambda}(k,l+1)+(1-\alpha(k,l))|Y(k,l)|^2,$$

where $\hat{\lambda}(k,l+1)$ denotes an estimated noise, k denotes a frequency index, and l denotes a frame index;

the second equation is defined as $\alpha(k,l)=\tilde{\alpha}(k,l)+(1-\tilde{\alpha}(k,l))p(k,l)(1-I_1(k,l))$, where p(k,l) denotes a probability that a voice will be present, k denotes a frequency index, and l denotes a frame index; and wherein the third equation is defined as $\tilde{\alpha}(k,l)=\alpha_{ds}+(\alpha_{dt}-\alpha_{ds})I_1(k,l)$, where $\alpha_{ds}=0.95$, and $\alpha_{dt}=0.05$, and $\alpha_{ds}$ and $\alpha_{dt}$ denote update coefficients of a stationary noise section and a burst noise section, respectively.

20. The method of claim 11, wherein detecting and canceling the burst noise further comprises when a burst noise is not detected, estimating that a stationary noise is present.

* * * * *